United States Patent [19]

Izzi, Sr.

[11] 3,967,836

[45] July 6, 1976

[54] OFFSET PLASTIC FLANGE FOR CONNECTING TOILET BOWLS TO DRAIN PIPES

[76] Inventor: Lewis B. Izzi, Sr., 918 Surrey Drive, Shelby, N.C. 28150

[22] Filed: Apr. 16, 1975

[21] Appl. No.: 567,471

[52] U.S. Cl. ..... 285/12; 4/68; 4/252 R; 285/58; 285/DIG. 16

[51] Int. Cl.[2] ..... E03D 11/13

[58] Field of Search ..... 285/58, 59, 60, 56, 285/12, DIG. 16, 177, 57; 4/252 R, 68

[56] References Cited

UNITED STATES PATENTS

| | | | |
|---|---|---|---|
| 938,533 | 11/1909 | Wheeler | 285/58 |
| 2,159,811 | 5/1939 | Leonardo | 285/12 |
| 2,899,690 | 8/1959 | Clifford | 285/58 X |
| 3,015,501 | 1/1962 | Minella | 285/58 |
| 3,140,104 | 7/1964 | Cosper | 285/59 |
| 3,775,780 | 12/1973 | McEwen | 285/58 X |

*Primary Examiner*—Thomas F. Callaghan
*Attorney, Agent, or Firm*—Raymond N. Matson

[57] ABSTRACT

A plastic economical connection between toilet bowls and unaligned drain pipes which eliminates the conventional time consuming and relatively costly brazing or leading step required of the installing plumber, and which connection will readily fit the 3 or 4 inch diameter plastic pipes currently used by plumbers.

1 Claim, 6 Drawing Figures

FIG.1
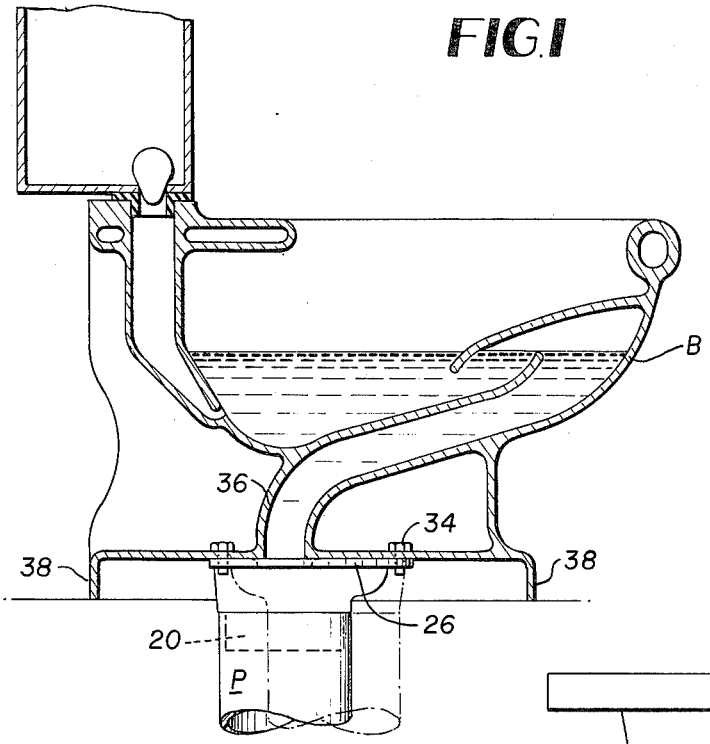
FIG.2
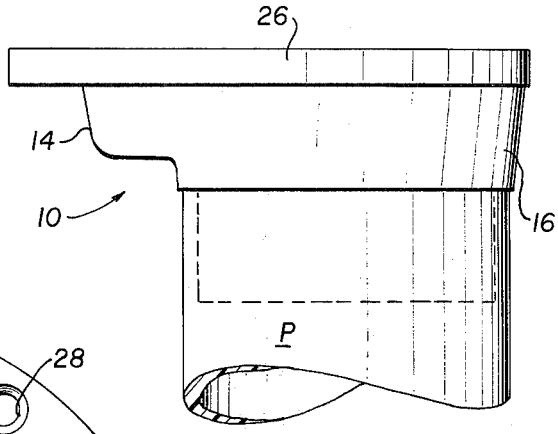
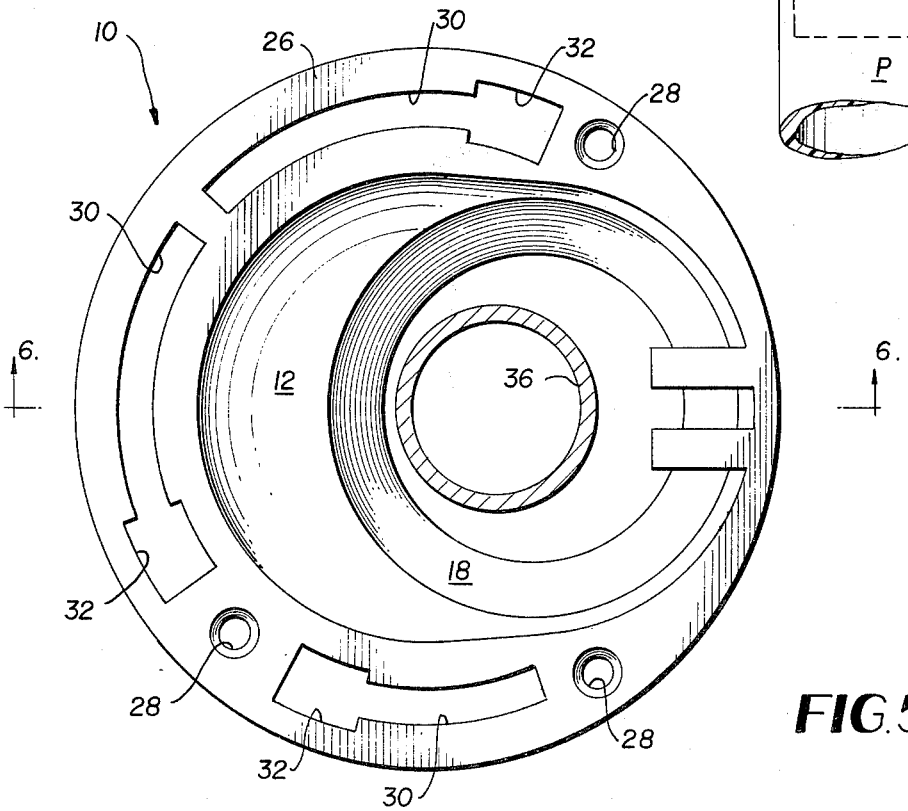
FIG.5

OFFSET PLASTIC FLANGE FOR CONNECTING TOILET BOWLS TO DRAIN PIPES

This invention relates generally to connectors for misaligned devices and more particularly to an offset plastic flange for connecting toilet bowls to drain pipes regardless of where the plumber has placed the drain pipe, within a predetermined range. This allows the toilet bowl to be positioned the required distance from a finished wall beside or behind the bowl while still connecting it with the installed drain pipe.

Offset flanges of this general type are known in the art but as a whole are characterized by certain inherent disadvantages. Among these are: an improper size so as to not fit standard drainage systems using 3 or 4 inch diameter pipes; they require an unnecessary amount of floor preparation, thus costing the plumber or installer precious time and money; the need to pack and lead the offset cast iron or brass offset flange when the architect specifies plastic pipes again costing time and money; and a relatively high cost and loss through breakage.

Accordingly, the main object of the present invention is to provide an improved offset flange connector which will obviate the above and other disadvantages characterizing known prior art.

An important object of the present invention is to provide an improved plastic flange connector which may be readily used with 3 or 4 inch drain pipes of plastic and quickly sealed thereto by use of a glue or solvent cement.

Another important object of the present invention is to provide an improved offset flange for connecting toilet bowls to drain pipes which will eliminate the need for plumbers and contractors to have their money tied up in unnecessary inventories with flanges specifically designed to do just one job.

A further important object of the present invention is to provide a rust proof, light-weight, strong and economical flange which is easily handled and enables a considerable saving on labor and installation costs.

Other objects and advantages of the invention will become apparent during the course of the following description.

In the drawings, I have shown one embodiment of the invention. In this showing:

FIG. 1 is a side elevational view of the invention showing it in operative position between a toilet bowl shown partly in section and a 4 inch drain pipe;

FIG. 2 is a side elevational view to a larger scale showing the connection between the plastic offset flange comprising the present invention and a plastic 4 inch pipe;

FIG. 5 is a top plan view to an enlarged scale of the plastic offset flange showing how the 2 inch discharge pipe of a toilet bowl discharges into the bowl portion of the invention.

Figure 6:
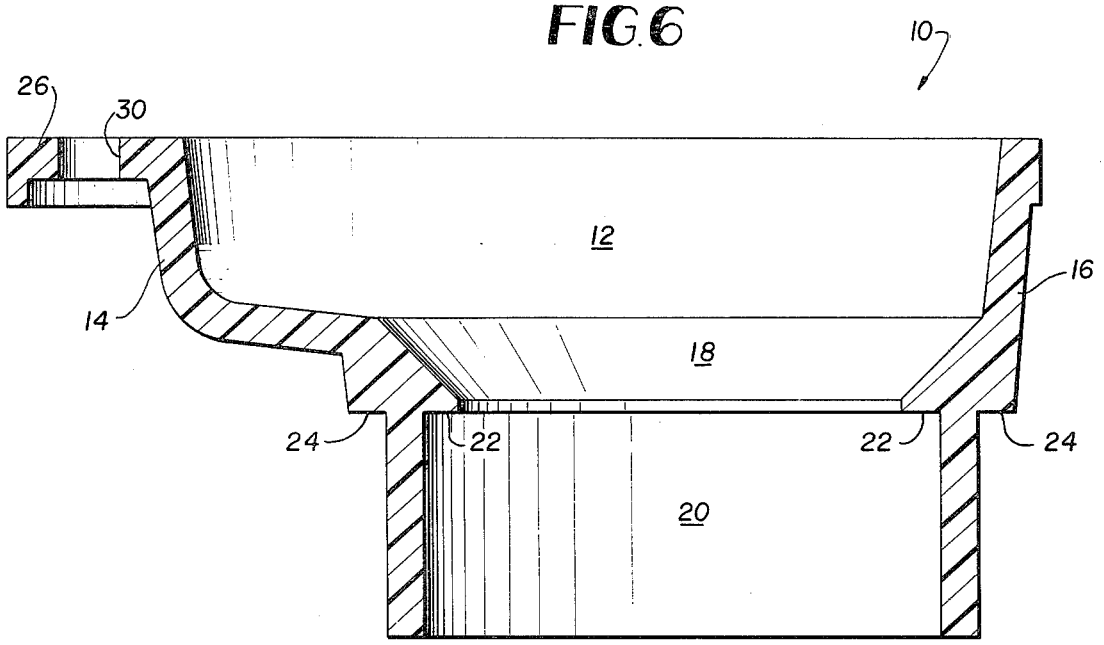
FIG. 6 is a central vertical sectional view of the invention taken on the line 6—6 of FIG. 5.
Figure 3:
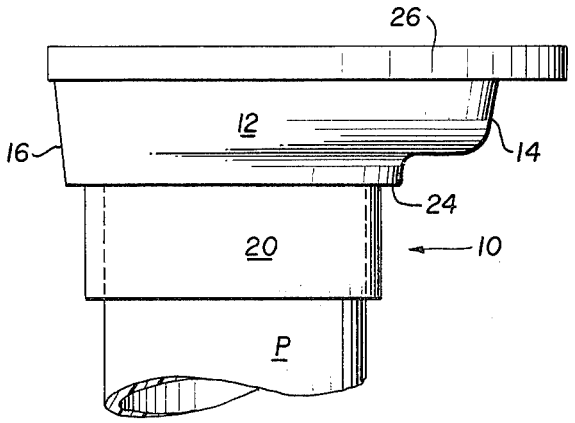
FIG. 3 is a similar view at 180° showing the invention's connection with a plastic 3 inch pipe.
Figure 4:
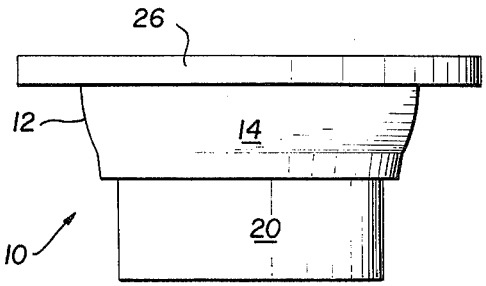
FIG. 4 is a front elevational view to a reduced scale of the invention.

Referring to FIGS. 5 and 6 of the drawings, numeral 10 designates the offset flange connection as a whole which comprises a relatively large bowl portion 12 having a front wall 14 and a rear wall 16. Adjacent the rear wall is an offset, downwardly tapered outlet section 18 which overlies an outlet tube 20 which is inset from the rear wall 16 to thus form a pair of annular shoulders 22 and 24.

The upper bowl portion is provided with a circular flange 26 having bolt holes 28 and annular slots 30 having enlarged ends 32 to receive the heads of upwardly projecting bolts 34 to which the toilet bowl B is fastened, the conventionally required odor eliminating wax or putty ring (not shown) being placed between the flange 26 and the base of the bowl B.

As is shown in FIGS. 1 and 5, the water in the toilet bowl B is discharged by means of a 2 inch discharge pipe 36 into the bowl 12 of the offset flange connector 10 which may be offset forwardly, backwardly or to the right or left with respect to the outlet tube 20.

In installation, the drain pipe P (FIG. 1) is cut off to the proper height and the offset flange connector 10 is then mounted therein or thereon to either of the shoulders 22 or 24 to which the drain pipe P is sealed by a glue or fused with a solvent cement. The odor preventing wax or putty ring is now positioned on the circular flange 26 with the toilet bowl securing bolts 34 properly position therein. The bowl B is now positioned by its apertures (not shown) in the depending flange 38 and nuts are applied to the bolts and capped for appearance (not shown).

It will now be apparent that the offset plastic flange connector comprising the present invention has a 2 inch internal adjustment possible with respect to the 2 inch toilet bowl drain pipe 36 and a further 2 inch external adjustment with respect to its shouldered outlet tube 20 which enables it to substantially position the toilet bowl as desired within that 4 inch range, and may be used with 3 or 4 inch drain pipes.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. A plastic offset flange connector for positioning toilet bowls in a given position with respect to a wall and connecting its bowl outlet pipe with an unaligned floor-positioned plastic drain pipe comprising; a large connector bowl having a front and a rear wall and an outlet tube and being open at its top in a generally elliptical configuration and having a downwardly tapering outlet section inwardly overlying and terminating in said outlet tube; said outlet tube being inset from said rear wall to form a pair of spaced inner and outer annular shoulders to optionally seat the upper end of different sized plastic drain pipes; said annular shoulders being fuseable to the upper end of said plastic drain pipe with solvent cement; and an annular flange projecting from the upper edge of said connector bowl for sealed connection with said toilet bowl.

* * * * *